US005957338A

United States Patent [19]

Lehmann

[11] Patent Number: 5,957,338

[45] Date of Patent: Sep. 28, 1999

[54] REFILLABLE CONTAINER FOR HIGHLY VISCOUS MEDIA

[75] Inventor: Manfred Lehmann, Cologne, Germany

[73] Assignee: Intec Bielenberg GmbH & Co., KG, Kerpen-Turnich, Germany

[21] Appl. No.: 08/923,635

[22] Filed: Sep. 4, 1997

[30] Foreign Application Priority Data

Sep. 9, 1996 [DE] Germany ..... 196 36 581

[51] Int. Cl.[6] ..... B67D 5/06

[52] U.S. Cl. ..... 222/184; 222/185.1; 222/342; 222/387; 222/481.5

[58] Field of Search ..... 222/147, 184, 222/185.1, 342, 386, 387, 394, 481.5

[56] References Cited

U.S. PATENT DOCUMENTS

| | | | |
|---|---|---|---|
| 3,138,303 | 6/1964 | Hoveland | 222/387 |
| 3,786,966 | 1/1974 | Behunin et al. | 222/387 |
| 4,428,507 | 1/1984 | Sneider | 222/184 |
| 4,552,090 | 11/1985 | Coleman | 116/204 |
| 4,790,456 | 12/1988 | Nakane et al. | 222/183 |
| 5,282,550 | 2/1994 | Coleman | 222/185.1 |
| 5,297,702 | 3/1994 | Crosby et al. | 222/185.1 |

FOREIGN PATENT DOCUMENTS

| | | | |
|---|---|---|---|
| 0463991 | 1/1992 | European Pat. Off. | 222/386 |
| 9319341 | 2/1994 | Germany . | |

*Primary Examiner*—Joseph A. Kaufman
*Attorney, Agent, or Firm*—Antonelli, Terry, Stout & Kraus, LLP

[57] ABSTRACT

The invention relates to a refillable container that implements the first-in/first-out principle for highly viscous media, with an interior chamber delimited by a bottom and side walls and with a removal channel formed in the bottom of the container and with a follower plate placed loosely in the interior of the container, said plate sealing off the interior chamber and being sealed off from the side walls of the container, said plate further being movable upward or downward under the influence of pressure in the interior of the container, with a filling chamber for the medium being capable of being isolated from the interior chamber between the follower plate and the bottom of the container, and with a filling channel for loading the medium into the filling chamber and with a vent channel for venting the filling chamber running through the follower plate, and with the filling channel and air supply channel each being connectable with a line brought out of the container and being sealable as well.

23 Claims, 3 Drawing Sheets

REFILLABLE CONTAINER FOR HIGHLY VISCOUS MEDIA

BACKGROUND OF THE INVENTION

The invention relates to a refillable muti-use container for highly viscous media that uses the first-in/first-out principle.

Highly viscous media, such as adhesives, fats, oils, pastes, etc. are usually loaded into drums by manufacturers and transported to the consumer. It is known for example from U.S. Pat. No. 4,790,456 to force a highly viscous medium upward through a riser out of a full drum by means of a descending compressor piston, but in this case, in accordance with the last-in/first-out principle, the medium that was last added to the drum is removed first, with the consequence that the medium that was loaded earlier and remains in the bottom area of the drum can become unusable and must be discarded. In addition, the expression of the medium from the drum can be impeded by air inclusions in the medium and may be rendered impossible.

For example, it is conventional in automobile manufacture to use adhesives prepared in known drums to glue together panels in the vehicle body. These adhesives are usually expressed from the drum in the manner described above and applied through a robot-controlled nozzle by means of a metering pump. During the operation of such automated devices, in addition to the problems mentioned above, it frequently happens that as the medium is being expressed from the drum, and especially when changing drums, ambient air comes in contact with the adhesive, triggering premature curing processes and resulting in clogging. As a result, the drum together with the remaining adhesive contained therein becomes unusable and must be discarded by the consumer at considerable expense.

In addition, the devices required for emptying the drum using a compression piston and a drive are very expensive and make the replacement of an empty drum by a new one undesirably cumbersome.

When an empty drum is being replaced by a full drum, medium often escapes with the result that the area becomes contaminated. Depending on the medium being used, this escape of the medium can also lead to the development of harmful vapors or the like, posing considerable problems. In addition, the drums used previously are intended for only a single use, increasing the cost of disposal.

A drum for highly viscous media that uses the first-in/first-out principle is known from U.S. Pat. No. 4,552,090, said drum having a removal channel formed in the bottom area and a follower plate that rests on the loaded medium.

The disadvantage of this known drum is that because it lacks suitable filling and ventilating and/or venting provisions, it is suitable for only a single use, and because it also has a costly follower plate, it does not make economic sense to use. When the known drum is used and then discarded, therefore, an unacceptably high cost is necessarily involved.

SUMMARY OF THE INVENTION

The goal of the invention therefore is to propose a refillable container for highly viscous media, said container making it as simple as possible to replace an empty container by a full one without the medium escaping, and with removal of the loaded medium proceeding as simply as possible, with no disposal problems of any kind being imposed on the consumer.

The invention achieves this goal with a refillable container that uses the first-in/first-out principle for highly viscous media, with an interior chamber delimited by a bottom and side walls and a removal channel being formed in the bottom of the container, and with a follower plate, said plate being placed loosely in the interior of the container, covering the interior and sealed off from the side walls of the container, said plate further being capable of being moved upward or downward under the influence of pressure in the interior of the container, with a filling chamber for the medium being separable from the interior chamber between the follower plate and the bottom of the container, and with a filling channel for loading the medium into the filling chamber and a venting channel for venting the filling chamber running through the follower plate, and with the air supply channel and the venting channel each being connectable with a line brought out of the container, said line being closable.

When the highly viscous medium is loaded under pressure through the filling channel into the filling chamber of the container according to the invention, the follower plate is lifted by the increasing pressure as the filling level rise, said plate resting on the top of the medium located in the filling chamber and being sealed off from the side walls of the container, so that the filling chamber is sealed off in an airtight fashion on all sides and premature aging of the loaded medium is ruled out, which could otherwise occur as the result of contact with ambient air.

After the filling chamber has been completely filled, a corresponding venting device can be connected to the venting channel in order to evacuate completely any air that might still be present in the filling chamber from said chamber. In this state, with the filling chamber evacuated and filled with medium, the container according to the invention can be shipped to the consumer, with the evacuation of the filling chamber also removing air from the medium contained in the filling chamber and avoiding air inclusions.

The medium contained in the filling chamber of the container according to the invention is removed through the removal channel, to whose outlet a pump, for example a dipper piston pump, can be connected by the consumer, said pump producing a vacuum in the interior chamber as it operates, so that the medium contained in the filling chamber is drained through the removal channel and the follower plate sinks as the level of the medium falls. The follower plate, as it sinks, slides along the side walls of the container according to the invention, ensuring a uniform material flow corresponding to the drop in the filling level in the filling chamber. When the filling chamber has been emptied, the follower plate lies on the bottom of the container and the container according to the invention, thus emptied, can be returned to the manufacturer to be refilled.

If the follower plate is resting too firmly on the bottom when it is time for refilling through the filling channel, because the empty container according to the invention was stored too long, and the plate cannot automatically rise under the influence of the medium now being added through the filling channel, it is proposed that an air supply channel pass through the follower plate in addition to the filling and venting channels, said air supply channel being connectable with a line brought out of the container, said line being closable. Compressed air can be blown in briefly between the bottom and the follower plate through this air supply channel, making it easier to lift the follower plate. It is also possible to use the air supply channel to suck out any residual amounts inside the filling chamber or to blow them out through the removal channel using compressed air.

Advantageously, an annular gap to allow movement of the follower plate inside the container is formed between the side walls of the container and the circumference of the follower plate, so that the follower plate, corresponding to the level of the highly viscous medium added to the filling chamber, can move upward and downward unimpeded along the side walls of the container and is always in contact with the highly viscous medium located in the filling chamber. In order to prevent access of ambient air, for example through the annular gap into the filling chamber and the highly viscous medium contained therein, the follower plate is provided on its circumference facing the side walls of the container with at least one circumferential sealing element that seals off the annular gap.

One advantageous embodiment of the invention provides that the follower plate is made in several parts and comprises a follower plate bottom and a follower plate top, and at least one sealing element is provided for sealing off the follower plate from the side walls of the container, and the follower plate bottom and follower plate top are releasably connected with one another by a screw connection for example.

In a preferred embodiment of the invention, the follower plate is made in three parts and comprises a follower plate bottom, follower plate top, and an intermediate plate located therebetween, said plates being releasably connected with one another by means of screw connections for example. The intermediate plate is separated from the follower plate top by spacers, and sealing elements to seal off the follower plate from the side walls of the container are fastened between the intermediate plate and the follower plate bottom.

Another advantageous embodiment of the container according to the invention provides that the follower plate is made in two parts and comprises a follower plate bottom and a follower plate top. On the follower plate bottom, on its side facing the follower plate top, an annular body is mounted whose outside diameter is smaller than the outside diameter of the follower plate so that the follower plate top and the follower plate bottom project laterally beyond the outer circumference of the annular body and form a receiving groove for sealing elements, and the follower plate top rests on the annular body and is releasably fastened to said annular body.

In an improvement on this embodiment it is proposed that the annular body have a circumferential rib on its outer circumference, the outside diameter of said rib being the same as or smaller than the outside diameter of the follower plate. This rib divides the receiving groove into two receiving grooves, preferably of the same size, to receive sealing elements.

Flat seals or O-rings made of an elastic material such as rubber are provided as sealing elements for the container according to the invention, with it also being possible in particular to provide flat seals and O-rings as sealing elements in combination with a follower plate of the container according to the invention, depending on the application.

The sealing action of the sealing elements provided between the follower plate and the side walls of the container can be varied for example by appropriately tightening the screw connections between the follower plate bottom and the follower plate top, so that a corresponding pressure is exerted on the sealing elements located between the follower plate top and follower plate bottom to produce a permanent seal against the side wall of the container.

In order to make it easy for the follower plate to slide easily along the side wall of the container according to the invention, depending on the filling level of the medium in the filling chamber, it is proposed that at least two guide elements for guiding the follower plate be provided on the top of the follower plate that faces away from the bottom of the container. These guides can be designed for example as projecting skids that prevent the follower plate from tilting in the container according to the invention.

It is also possible to design the guide elements as guide rollers, each secured on the follower plate top, with the rotational axes of the guide rollers being made to run parallel to the follower plate, and with the guide rollers being mounted on the follower plate in such fashion that they roll along the side walls of the container when the follower plate is located inside the container, thus preventing the follower plate from tilting. For example, provision can be made to locate, on the top of the follower plate, four guide elements equally spaced apart on the follower plate in the vicinity of its circumference, said guide elements each comprising two guide rollers mounted one above the other in a frame.

For uniform filling of the filling chamber, the filling channel is preferably located centrally in the follower plate.

In order to simplify the handling of the container according to the invention, it is proposed that the side walls of the container project downward over the bottom and form a base with a base chamber, and that a tube stub be mounted on the removal channel of the bottom, said stub projecting into the base chamber and being closable by a lid. After removal of this lid that seals the tube stub, the highly viscous medium that was loaded into the filling chamber of the container according to the invention can be removed through the removal channel in the bottom of the container and through the tube stub connected thereto.

However, it is also possible for the tube stub to be equipped with a branch tube that runs parallel to the bottom of the container through the base chamber and the base. Through this branch tube, the highly viscous medium loaded into the filling chamber of the container according to the invention can be removed through the removal channel in the bottom, laterally from the container according to the invention in the base area and removed therefrom, which is especially advantageous in the case of drums that stand directly on a foundation. By removing the lid that seals the projecting tube stub and mounting this lid on the end of the branch tube, the container according to the invention so designed can be prepared in a short time for removal of medium through the pipe stub.

In order to facilitate the handing of the container according to the invention, it is proposed that a quick-connect coupling be provided at the end of the pipe stub and/or the branch tube for connecting a removal line for the highly viscous medium. Such quick-connect couplings are known and make it possible in simple fashion to connect the removal line. This connection can be performed by a single motion of the hand or completely automatically.

Another embodiment of the invention provides that on the end of the filling channel, away from the bottom and/or the vent channel and/or the air supply channel on the follower plate, the abovementioned quick-connect couplings are also provided for connecting lines for the filling channel and/or vent channel and/or air supply channel. In this case also, the quick-connect couplings which are commercially available make it possible to connect a line in a very simple fashion.

In order to protect the quick-connect couplings and shut-off valves located on the top of the follower plate reliably against damage, it is proposed that a removable cover for sealing off the interior chamber be fastenable on the side of the container opposite the bottom.

According to one embodiment of the invention, the top is provided with through openings to allow lines to pass through for the filling channel and/or venting channel and/or air supply channel of the follower plate.

Another embodiment of the invention provides that quick-connect couplings are provided in the vicinity of the through openings in the top for connecting lines for the filling channel and/or vent channel and/or air supply channel. Between the top and the follower plate, hoses are provided that run from the quick-connect couplings on the top to the respective removal channel, vent channel, and/or air supply channel of the follower plate.

Advantageously, the quick-connect couplings that are used in the embodiments of the invention described above are so designed that when the line is uncoupled, they automatically produce gastight seal which is usually made possible by integrating corresponding automatically operating shutoff valves in the quick-connect couplings.

In order to permit easy adjustment to existing transport systems as well as removal equipment, it is proposed that the container be designed like a drum with a round cross section of the side walls and that it have a size and capacity that match those of known drum-type containers.

In order to ensure that the mobility of the follower plate along the side walls of the container according to the invention always remains uniformly good, even over long periods of use and frequent refilling, it is proposed that a spray line with a plurality of spray nozzles directed at the side walls of the container be provided on the side of the top facing the interior chamber, through which spray line a lubricant can be sprayed if necessary to allow the follower plate to move along the side walls of the container.

For example, a liquid that is compatible with the medium loaded into the container according to the invention can be used as the lubricant. Thus for example it is possible when the container according to the invention is filled with a PVC-based adhesive to spray a plasticizer compatible with this adhesive, which is already contained in the PVC being used, in a fluid solution as a lubricant onto the side walls of the container, making it possible for the follower plate to slide easily while the negative influences on the highly viscous medium loaded into the container according to the invention are eliminated.

BRIEF DESCRIPTION OF THE DRAWINGS

The invention will now be explained in greater detail on the basis of embodiments shown in the drawing.

DETAILED DESCRIPTION OF THE PREFERRED EMBODIMENTS

Figure 1:
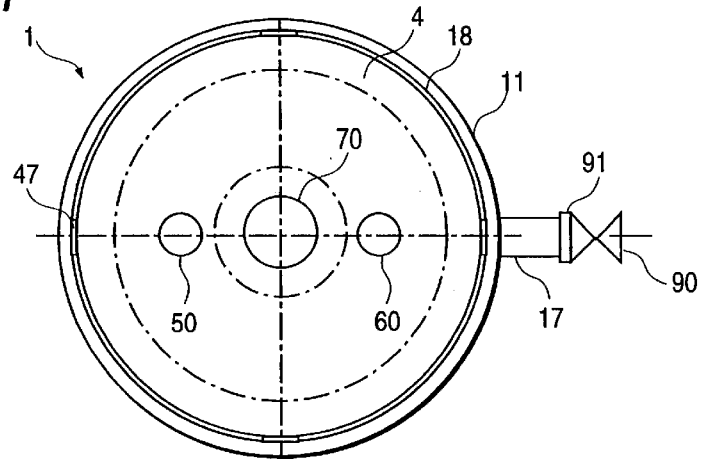
FIG. 1 is a top view of a reusable container.
Figure 2:
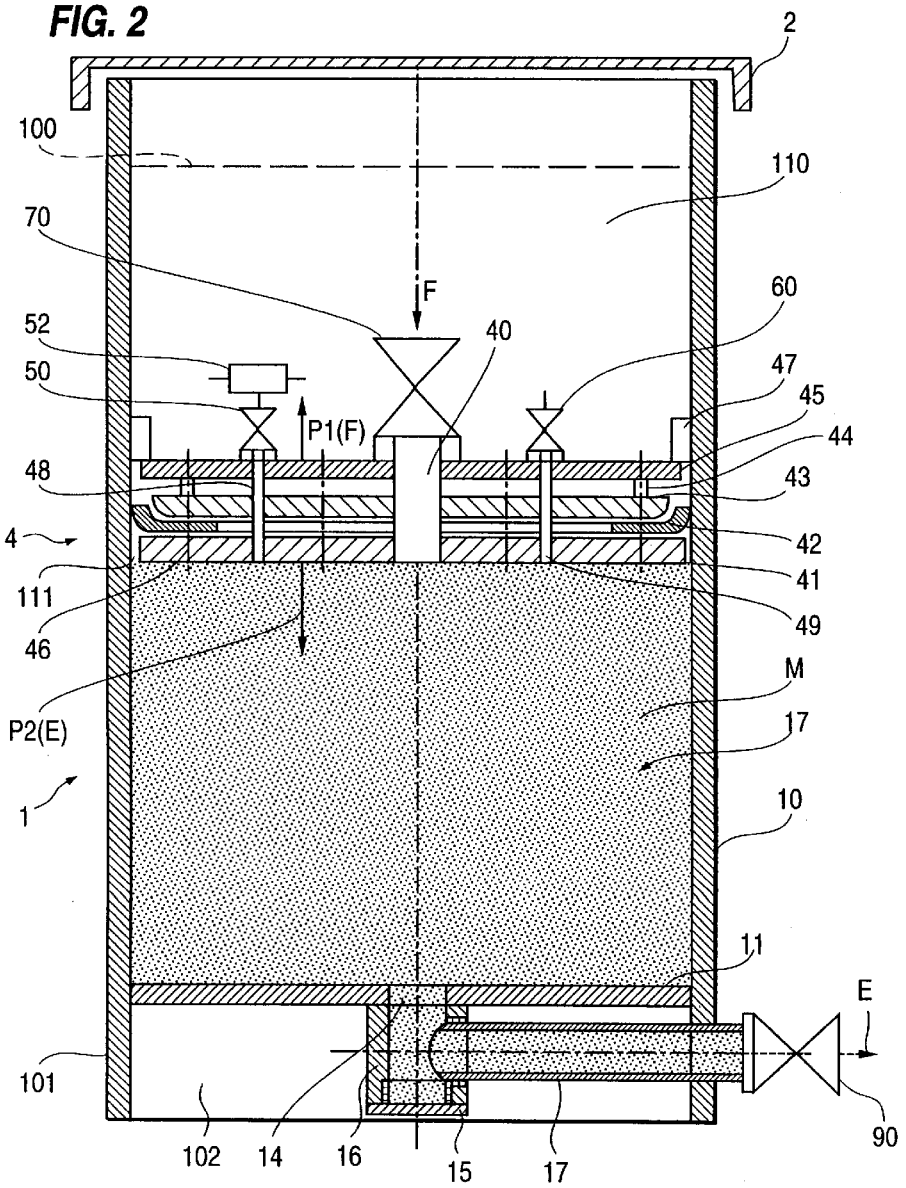
FIG. 2 is a vertical section through a reusable container according to FIG. 1 in an enlarged view.

According to FIG. 1, container 1 is made in the shape of a drum with a round cross section of side walls 10 and, as can also be seen from FIG. 2, has an interior chamber 110 delimited from a bottom 11 and side walls 10.

In interior chamber 110 of container 1, above bottom 11, a follower plate 4 is inserted loosely, leaving an annular gap 111, with a filling chamber 17 being formed between follower plate 4 and bottom 11 for medium M to be loaded, said filling chamber being separated by follower plate 4 from the remaining interior chamber 110 of container 1.

Follower plate 4 is made in three parts, with a follower plate top 45, a follower plate bottom 41, and an intermediate plate 43 located therebetween. Intermediate plate 43 is spaced apart from follower plate top 45 by spacers 44, and a flat seal 42 is inserted between intermediate plate 43 and follower plate bottom 41, said seal sealing off follower plate 4 from side wall 10 of container 1 and covering annular gap 110. Follower plate top 45, intermediate plate 43, and follower plate bottom 41 are connected with one another by a plurality of screw connections 46, so that by appropriate tightening of screw connections 46 an application pressure is exerted between intermediate plate 43 and follower plate bottom 41 on flat seal 42, resulting in permanent mounting and long-term sealing action of flat seal 42 against side wall 10 of container 1.

Follower plate 4 has a centrally located filling channel 40 passing through follower plate 4 for loading medium M in filling chamber 17. In addition, an air supply channel 49 and a vent channel 48 pass through follower plate 4 into filling chamber 17.

On the top of follower plate top 45, filling channel 40 has a quick-connect coupling 70 for connecting a feed line for the material to be loaded. In addition, vent channel 48 and air supply channel 49 have corresponding quick-connect couplings 50, 60 for connecting a vent or air supply device.

In addition, bottom 11 of container 1 has a central opening to filling chamber 17 that serves as a removal channel 14 for medium M loaded into filling chamber 17. The side walls 10 of container 1 project downward over bottom 11 and form a circumferential base 101 with a surrounding base chamber 102. In this base chamber 102, a tube stub 16 is mounted on the removal channel 14 that is formed in bottom 11 and projects into base chamber 102, said pipe stub being closed by a lid 15. In addition, tube stub 16 is equipped with a branch tube 17 that is brought out parallel to bottom 11 of the container through base chamber 102 and base 101 from container 1. At the end of this branch tube 17 that communicates with removal channel 14, a quick-connect coupling 90 is in turn provided for connecting a removal line, not shown in greater detail.

To fill container 1 with a highly viscous medium, a feed line, not shown, for the highly viscous medium is connected to quick-connect coupling 70 of filling channel 40. This causes a shutoff valve integrated in the quick-connect coupling to open, and medium M can then be loaded into filling chamber 17 in the direction of arrow F under pressure between follower plate 4 and bottom 11 of container 1. As the level of medium M in filling chamber 17 rises, follower plate 4 also rises as a result of the increasing pressure in filling chamber 17 as indicated by arrow P1(F), with medium M located in filling chamber 17 being sealed off from the environment by flat seal 42. Container 1 is then filled with medium M until the upper filling limit indicated by the dashed lines is reached. The feed line can then be removed from quick-connect coupling 70 of filling channel 40 without ambient air entering filling chamber 17, since an airtight seal is automatically produced in known fashion in the shutoff integrated into quick-connect coupling 70. Any air that is still located inside filling chamber 17 can be drawn off through vent channel 48. For this purpose, a Venturi nozzle 52 is connected to quick-connect coupling 50 of vent channel 48 so that by charging Venturi nozzle 52 with a stream of compressed air, any air that is still located in filling chamber 17 is evacuated, and after evacuation is complete and shutoff valve 51 closes again, medium M in filling chamber 17 has had all the air removed from it and is stored with air excluded.

Even during the filling of container 1 with medium M, Venturi nozzle 52 can already be charged with compressed air in order to draw off any penetrating air immediately through vent channel 48.

Container 1, thus filled and evacuated, is now ready for shipment and can be transported to the consumer.

If the above-described lifting of follower plate 4 in the direction of arrow P1 (F) does not take place automatically when filling chamber 17 is filled, possibly because residual amounts of medium that are still present cause a slight sticking follower plate 4 to bottom 11 in telling chamber, a compressed air line can be connected to quick-connect coupling 60 and compressed air can be blown through air supply channel 49 into filling chamber 17, thus reinforcing the lifting of follower plate 4 during the filling process. It is also possible, before filling container, 1 to blow compressed air into filling chamber 17 through air supply channel 49 in order for example to blow out any material remaining in removal channel 14, just as it is possible, by reversing air supply channel 49 and connecting a vacuum line to quick-connect coupling 60, to suck out any medium that may still be present in filling chamber 17 before it is refilled.

Air supply channel 49 can also be used as a level indicator during the filling of container 1. For this purpose, air supply channel 49 is opened during the filling of container 1, with a stop for follower plate 4 being provided in the vicinity of the maximum fullness level 100 of medium M. After the maximum fullness level is reached, medium escapes from open air supply channel 49, thus signaling complete filling of filling chamber 17.

In addition, surplus filling medium can be drawn off from filling chamber 17 through air supply channel 49.

In order to protect the shutoff and quick-connect couplings located on the top of follower plate 4 against damage, during transport for example, a removable cover 2 is mounted on the top of container 1.

To empty container 1 thus filled with medium and evacuated and sealed, a hose connection need only be attached to quick-connect coupling 90 of removal channel 14 and a pump connected thereto, for example a dipper piston pump that creates a vacuum in the interior of the drum when delivering, can empty the medium from filling chamber 17 in the direction of arrow E without ambient air entering container 1. As a result of the vacuum produced by the pump, not only does medium M leave filling chamber 17, but follower plate 4 also slides downward, in accordance with the reduced level and pressure drop inside filling chamber 17, in the direction of arrow P2 (E) and, reinforced by its own weight, ensures a uniform material flow in the direction of arrow E from removal channel 14 and quick-connect coupling 90.

In order to ensure that follower plate 4 slides as easily as possible along inside wall 18 of container 1, skid-shaped guides 47 are formed on the top of follower plate top 45, said guides preventing tilting of follower plate 4 as it moves in the direction of arrow P1 (F) or P2 (E).

After all of medium M has been drained from filling chamber 17 through removal channel 14, follower plate 4 rests on bottom 11, and container 1, now empty, after removal of removal line from quick-connect coupling 90, can be sent back to be refilled without ambient air penetrating the interior of filling chamber 17 for example.

As a result of this complete exclusion of air by quick-connect couplings 50, 60, 70, and 90, both when filling and also when removing medium from filling chamber 17, premature aging of medium M as a result of entry of ambient air is reliably prevented so that the consumer is no longer faced with problems relating to disposal, and container 1 can be reused many times.

In addition, filling channel 40 and removal channel 14 provided on opposite sides of container 1 ensure that that medium M that is first added to filling chamber 17 and collects in the vicinity of bottom 11 is also the first to be removed through removal channel 14, so that container 1 provides storage and removal of medium M according to the first-in/first-out principle and the risk of premature aging of medium M is prevented from this standpoint as well.

All the surfaces of container 1 that come in contact with medium M are advantageously treated to prevent adhesion of medium M. This can be an anti-adhesion coating for example, based on Teflon for example, or the surfaces can have an especially low degree of roughness, as a result of electropolishing or the like for example, and container 1 is advantageously made of a suitable stainless steel.

The lateral bringing out of removal channel 14 shown in the drawing from wall 10 of container 1 is to be considered only as an example and is designed in accordance with the prevailing conditions at the consumer's site. Of course, it is also possible to make removal channel 14 run perpendicularly downward from the bottom, for example if lid 15 is removed from the end of tube stub 16 instead of from tube stub 17 running horizontally.

Figure 3:
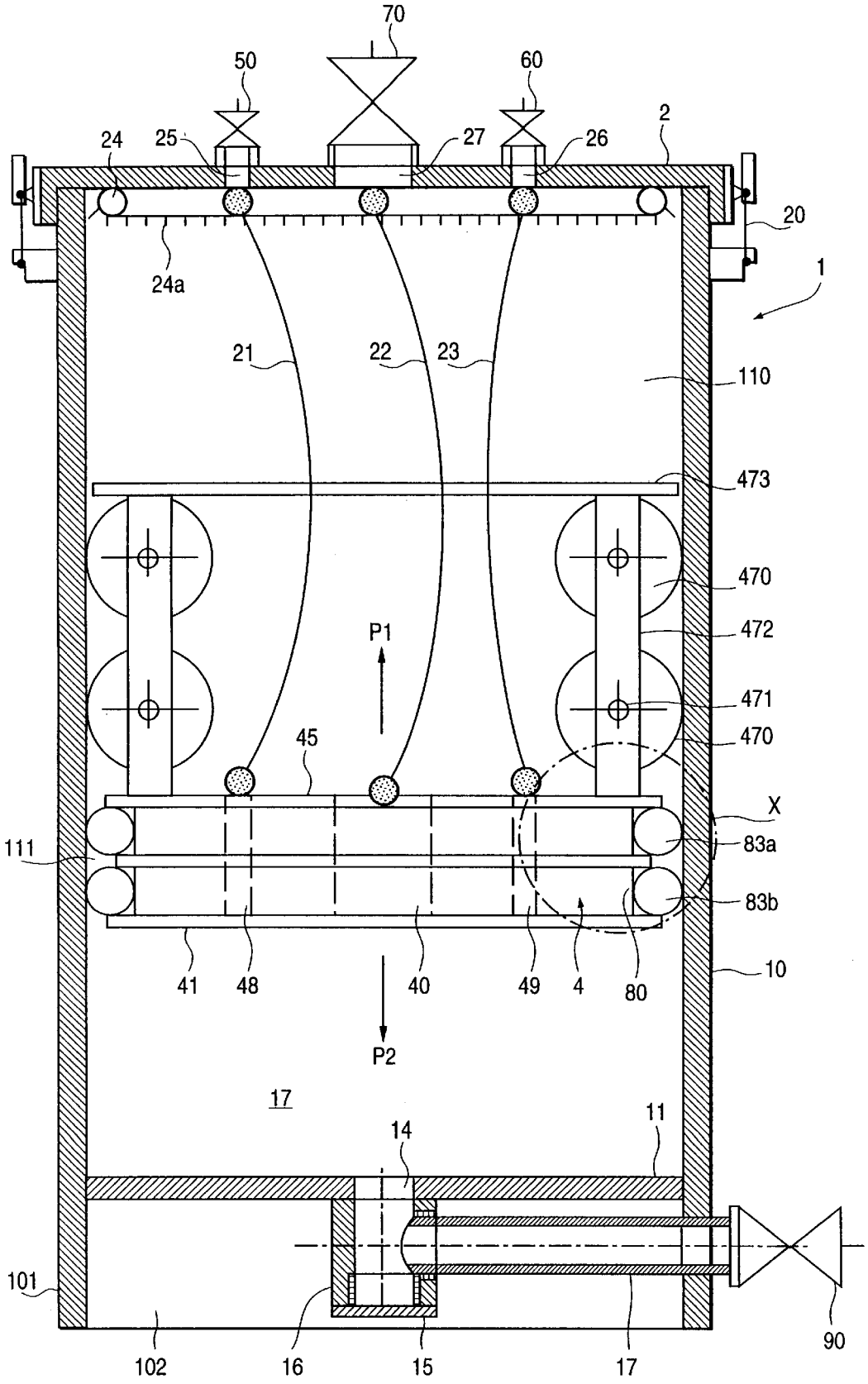
FIG. 3 is a vertical section through another embodiment of the container according to the invention.
Figure 4:
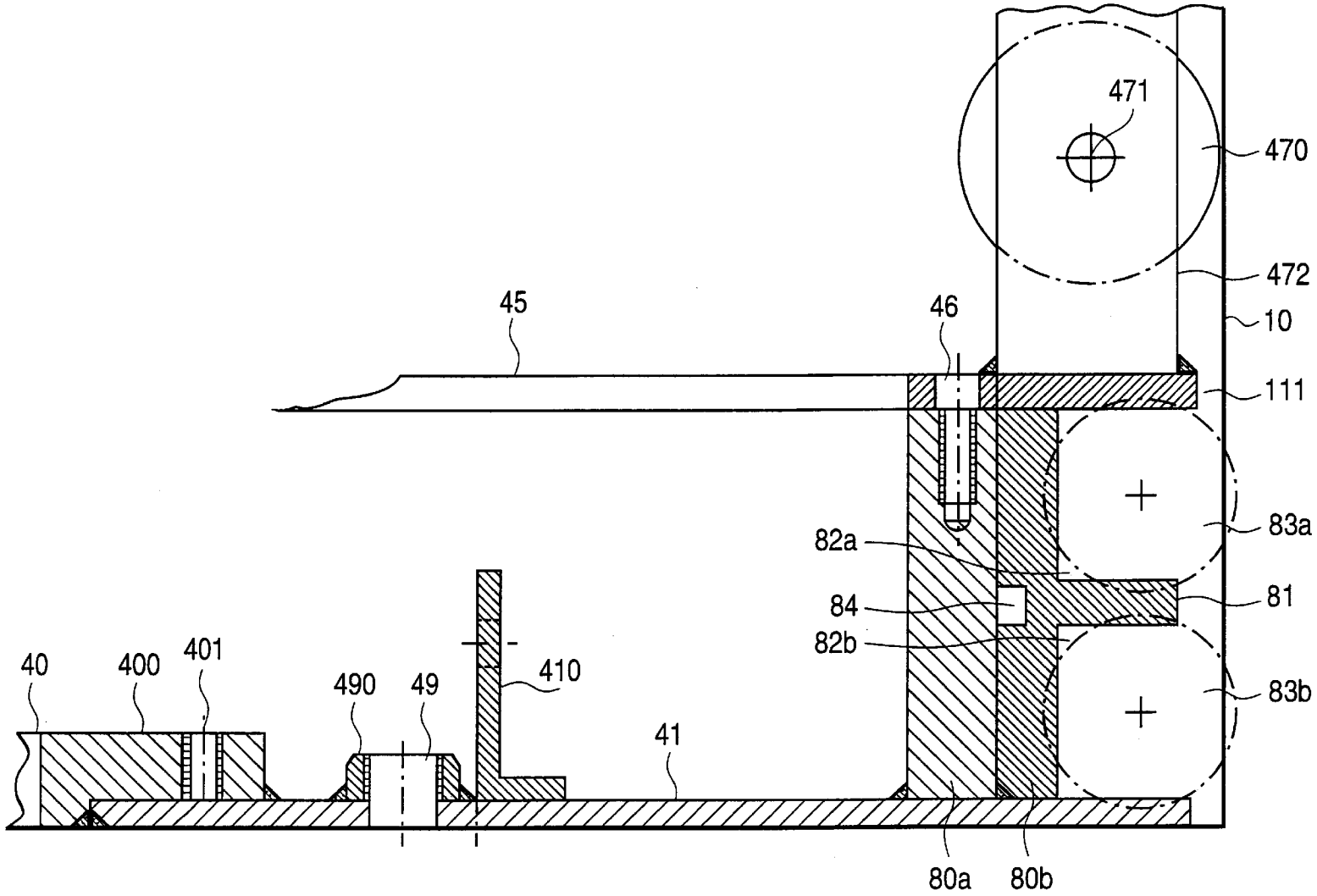
FIG. 4 is an enlarged view of detail X in FIG. 3.

FIGS. 3 and 4 show another embodiment of a refillable container 1 for a highly viscous medium, partially in schematic form. In contrast to the embodiment described above for container 1 in accordance with FIGS. 1 and 2, in this case follower plate 4 is made in two parts, with a follower plate bottom 41 and a follower plate top 45.

As is particularly evident from the enlarged view in FIG. 4, an annular body composed of two annular body parts 80*a* and 80*b* abutting one another is mounted on the top, facing follower plate top 45, of follower plate bottom 41 and is attached to said follower plate bottom 41, said annular body having a smaller outside diameter than follower plate bottom 41 and follower plate top 45. As a result, follower plate top 45 and follower plate bottom 41 project laterally beyond the outer circumference of the annular body and form a receiving chamber for sealing elements 83*a*, 83*b*. This receiving chamber for sealing elements is divided by a rib 81, formed on annular body part 80*b* and projecting in the direction of side wall 10 of container 1, into two receiving grooves 82*a*, 82*b* of equal size, into each of which grooves a sealing element for example an O-ring 83*a*, 83*b* made of an elastic material, rubber for example, is inserted to seal off follower plate 4 from side wall 10 of container 1, thus sealing off annular gap 111 between follower plate 4 and side wall 10.

The annular plate parts 80*a* and 80*b* that form annular body 80 are welded to follower plate bottom 41, while follower plate top 45 is releasably connected by screw connections 46 to annular body part 80*a* and to follower plate bottom 41.

In addition, a sealing groove 84 is formed on annular plate part 80*b* on the side facing annular plate part 80*a*, into which groove a sealing ring to seal off the gap between annular body parts 80*a* and 80*b* can be inserted.

In addition to the possibility illustrated in FIGS. 3 and 4 of sealing off follower plate 4 from side wall 10 of container 1 using two O-rings mounted one above the other and each in a receiving groove, it is also possible depending on the application and possible uses to fasten flat seals to follower plate 4 or to combine flat seals with O-rings to seal off follower plate 4 from side walls 10 of container 1.

To guide follower plate 4 inside side walls 10 of container 1, the latter has a plurality of guide elements on the top that faces away from follower plate bottom 11. In the embodiment according to FIG. 3, each guide element comprises two guide rollers 470 mounted one above the other in a frame 472, the rotational axes 471 of said rollers being arranged parallel to follower plate 4. Guide rollers 470 are located in the vicinity of the outer circumference of follower plate 4 in such fashion that they roll on side walls 10 of container 1 when the follower plate is placed in interior chamber 110, preventing follower plate 4 from tilting in container 1. In order to increase the stability of these guide elements, the individual frames 472 in which guide rollers 470 are held are also connected with one another by a common stabilizing ring 473 above frame 472. Follower plate 4 is equipped with at least two and preferably three or four guide elements located at equal intervals on the follower plate.

Refillable container 1 shown in FIG. 3 also has a top 2 for sealing off interior chamber 110 of the container, said top being releasably fastened by toggle clamps 20 to side walls 10 of container 1. Top 2 has recesses 25, 26, 27 on which quick-connect couplings 50, 60, 70 are mounted on the outside of top 2 facing away from bottom 11 of the container. On the inside of top 2 facing the bottom, hoses 21, 22, 23 run from openings 25, 26, and 27, to the respective channels formed in follower plate 4 by analogy with the previous embodiment. In this case, quick-connect coupling 70 is again provided for connecting a material supply line for the medium to be loaded into filling chamber 17 and is connected by hose 22 with filling channel 40 of follower plate 4. Quick-connect coupling 50 is connected by hose 21 with vent channel 48 and the Venturi nozzle that is mounted on it but is not shown in this case for the sake of simplicity. Quick-connect coupling 60 is connected by hose 23 with air-supply channel 49 of follower plate 4. It is therefore possible to connect the connecting lines for channels 40, 48, 49 formed in follower plate 4 to quick-connect couplings 50, 60, 70 on top 2 without removing top 2 from container 1, thus protecting interior 110 of container 1 against contamination and damage. Hoses 21, 22, 23 are therefore flexible and have lengths such that they can follow the movements of follower plate 4 between its end positions when filling chamber 17 is filled completely with medium and when filling chamber 17 is completely empty of medium.

It can also be seen from FIG. 3 that on the inside of top 2 that faces bottom 11 there is an annular spray line 24 with spray nozzles directed at side wall 10 of container 1. A lubricant can be sprayed onto side walls 10 of container 1 through this annular line 24 if required, for example at periodic intervals, to facilitate the movement of follower plate 4 along side walls 10.

For this purpose it is proposed for example to use a lubricant compatible with the medium loaded in filling chamber 17 in the form of a liquid. For example, in the case of PVC-based adhesives this can be a plasticizer, in an appropriate solution, that is contained in PVC.

The container described above according to the invention thus makes it possible to perform an extremely simple replacement of an empty container by a full container by connecting only a single removal hose to the corresponding quick-connect coupling. In this manner, the production interruptions required by an automatic removal device when changing containers are minimized. Even when the container is being filled with the medium, only one supply line must be connected to the corresponding quick-connect coupling, and can likewise be performed without great expense and at a high rate of speed.

As a result of the implementation of the first-in/first-out principle in the container according to the invention, in which the medium added first is also the first to be processed, aging of the medium in the container is prevented.

Container replacement at the consumer's site takes place with the containers completely sealed so that no medium can escape during container replacement, which prevents contamination of the container storage area and also considerably simplifies handling hazardous vapors from highly viscous media for example, since escape of the medium during container replacement is suppressed.

Since escape of the medium during container replacement is reliably prevented and the loaded medium is also not subject to premature aging thanks to the complete exclusion of air from the interior of the container, residual volumes and the need to remove waste material from the highly viscous medium can be prevented at the consumer's site, resulting in considerable cost savings and minimization of effort.

In addition, the device for automated emptying of the container can be made considerably simpler since it is only necessary to connect to the removal channel a pump that generates a vacuum, thus eliminating the additional equipment such as pump stands that was formerly used.

I claim:

1. Refillable container using the first-in/first-out principle for highly viscous media with an interior chamber (110) delimited by a bottom (11) and side walls (10), and with a removal channel (14) formed in bottom (11) of container (1) and a follower plate (4), loosely placed in the interior (110) of container (1), said plate covering interior chamber (110) and being sealed off from side walls (10) of the container, said plate further being movable upward and downward under the influence of pressure in interior chamber (110) of container (1), with a filling chamber (17) for the medium being divided from interior chamber (110) between follower plate (4) and bottom (11), and with a filling channel (40) being provided for loading the medium into filling chamber (17) through the follower plate and with a vent channel (48) for venting filling chamber (17) through follower plate (4) and with a vent channel (48) running through follower plate (4) for venting filling chamber (17), and with filling channel (40) and air supply channel (49) each being connectable and closable by means of a line brought out of the container.

2. Container according to claim 1, characterized in that an air supply channel (49) for supplying air to filling chamber (17) runs through follower plate (4), said channel being connectable with a line brought out of container (1) and also being closable.

3. Container according to claim 1, characterized in that an annular gap (111) is formed between side walls (10) of container (1) and the circumference of follower plate (4) to allow movement of follower plate (4) within container (1), with follower plate (4) being equipped at its circumference facing side walls (10) of container (1) with at least one sealing element **(42, 83*a*, 83*b*) that is circumferential and seals off annular gap (111)**.

4. Container according to claim 1, characterized in that follower plate (4) is made in several parts and comprises a follower plate bottom (41) and a follower plate top (45) and includes at least one sealing element **(42, 83*a*, 83*b*) to seal off follower plate (4) from side walls (10) of container (1), in that follower plate bottom (41) and follower plate top (45)** are releasably connected together.

5. Container according to claim 1, characterized in that follower plate (4) is made in three parts and comprises a follower plate bottom (41), a follower plate top (45), and an intermediate plate (43) located therebetween, said parts being releasably connected with one another, and in that intermediate plate (43) is separated from follower plate top (45) by means of spacers (44), and sealing elements (42, 83*a*, 83*b*) are located between intermediate plate (43) and follower plate bottom (41) to seal off follower plate (4) from side walls (10) of container (1).

6. Container according to claim 1, characterized in that follower plate (4) is made in two parts and comprises a follower plate bottom (41) and a follower plate top (45), and in that an annular body (80) is mounted on follower plate bottom (41) on its side facing follower plate top (45), the outside diameter of said annular body being smaller than the outside diameter of the follower plate (4), so that the follower plate top (45) and the follower plate bottom (41) project laterally beyond the outer circumference of annular body (80) and form a receiving groove for sealing elements and follower plate top (45) rests on annular body (80) and is releasably fastened to annular body (80).

7. Container according to claim 6, characterize that annular body (80) has a circumferential rib (81) on its outer circumference, the outside diameter of said rib being equal to or less than the outside diameter of follower plate (4), and in that rib (81) divides the receiving groove into two preferably equal receiving grooves (82*a*, 82*b*) to receive sealing elements.

8. Container according to claim 3, characterized in that at least one of flat seals and O-rings made of an elastic material are provided as sealing elements (42, 83*a*, 83*b*).

9. Container according to claim 1, characterized in that at least two guide elements (47, 470) to guide follower plate (4) along side wall (10) of container (1) are formed on the top of follower plate (4) that faces away from bottom (11) of container (1).

10. Container according to claim 9, characterized in that guide elements are provided in the form of at least one guide roller (470) mounted on follower plate top (45), with rotational axis (471) of guide roller (470) designed to move parallel to follower plate (4), and in that guide rollers (470) are located above follower plate (4) in such fashion that they roll on side walls (10) of container (1) when follower plate (4) is placed in interior (110) of the container.

11. Container according to claim 1, characterized in that filling channel (40) is located centrally in follower plate (4).

12. Container according to claim 1, characterized in that side walls (10) of container (1) project downward over bottom (11) and form a base (101) with base chamber (102), and in that a tube stub (16) that projects into base chamber (102) is provided on removal channel (14) of bottom (11), said stub being closable by a lid (15).

13. Container according to claim 12, characterized in that tube stub (16) is equipped with a branch tube (17) that extends parallel to bottom (11) of container (1) through base chamber (102) and base (101).

14. Container according to claim 12, characterized in that a quick-connect coupling (90) for connecting a removal line (E) for the medium is provided at the end of at least one of the tube stub (16) and a branch tube (17).

15. Container according to claim 2, characterized in that quick-connect couplings (50-, 60, 70) are provided at the end of filling channel (40) away from at least one of bottom (11), vent channel (48) and air supply channel (49) on follower plate (4) for connecting lines for at least one of filling channel (40), vent channel (48) and air supply channel (49).

16. Container according to claim 1, characterized in that a removable lid (2) for sealing off interior chamber (110) can be fastened on the top of container (1) opposite bottom (11).

17. Container according to claim 16, characterized in that lid (2) is designed with through openings (25, 26, 27) for passing through lines for at least one of filling channel (40), vent channel (48) and air supply channel (49) in follower plate (4).

18. Container according to claim 17, characterized in that quick-connect couplings (50, 60, 70) are provided on top (2) in the vicinity of through openings (25, 26, 27) for connecting lines for at least one of filling channel (40), vent channel (48) and air supply channel (49), and in that hoses (21, 22, 23) are provided between top (2) and follower plate (4) of container (1), said hoses being connected to the quick-connect couplings (50, 60, 70) and extending to at least one of removal channel (40), vent channel (48), and air supply channel (49) of follower plate (4).

19. Container according to claim 14 characterized in that quick-connect couplings (50, 60, 70, and 90) are designed so that they close gastight automatically when the line is uncoupled.

20. Container according to claim 1, characterized in that vent channel (48) of follower lid (4) is equipped on its side facing away from the filling chamber with a vent device in the form of a Venturi nozzle (52).

21. Container according to claim 1, characterized in that that container (1) is designed in the form of a drum with a round cross section.

22. Container according to claims 16, characterized in that a spray line (24) with a plurality of spray nozzles (24*a*) directed at side walls (10) of container (1) is provided on the side of top (2) that faces interior chamber (110), through which nozzles a lubricant can be sprayed as required to facilitate movement of follower plate (4) along side walls (10) of container (1).

23. Container according to claim 22, characterized in that a liquid that is compatible with the loaded medium is used as the lubricant.

* * * * *